US005090580A

United States Patent [19]

Nelson

[11] Patent Number: 5,090,580

[45] Date of Patent: Feb. 25, 1992

[54] TRUNK-MOUNTED PORTABLE CRANE

[75] Inventor: W. O. Nelson, Horton, Kans.

[73] Assignees: Walbert O. Nelson; Eleanor C. Nelson, both of Horton, Kans.

[21] Appl. No.: 579,608

[22] Filed: Sep. 10, 1990

[51] Int. Cl.[5] ..... B66C 23/44

[52] U.S. Cl. ..... 212/180; 212/241; 212/252; 414/462; 414/921

[58] Field of Search ..... 212/179, 180, 181, 241, 212/244, 252, 253, 254; 414/462, 463, 464, 465, 466, 921

[56] References Cited

U.S. PATENT DOCUMENTS

| | | | |
|---|---|---|---|
| 841,702 | 1/1907 | Martin | 212/254 |
| 1,161,258 | 11/1915 | Shelton | 212/254 |
| 1,271,277 | 7/1918 | Chabala | 212/241 |
| 1,400,540 | 12/1921 | Gloor | 212/180 |
| 1,540,135 | 6/1925 | Klinkhammer | 212/253 |
| 1,584,117 | 5/1926 | Mitchell | 212/176 |
| 1,688,507 | 10/1928 | Schuh | 212/254 |
| 2,093,617 | 9/1937 | Ormsby | 212/253 |
| 3,804,263 | 4/1974 | Castonguay | 414/462 |
| 4,391,379 | 7/1983 | Paffrath | 414/921 |
| 4,406,574 | 9/1983 | Riley | 212/180 |

FOREIGN PATENT DOCUMENTS

| | | | |
|---|---|---|---|
| 1121294 | 1/1962 | Fed. Rep. of Germany | 212/179 |
| 2306156 | 10/1976 | France | 212/179 |
| 57860 | 1/1936 | Norway | 212/253 |

*Primary Examiner*—Sherman Basinger
*Assistant Examiner*—Thomas J. Brahan
*Attorney, Agent, or Firm*—Litman, McMahon & Brown

[57] ABSTRACT

A portable crane for hoisting electric scooters, wheelchairs and the like includes a column assembly, a boom assembly, a base assembly and a winch assembly. The column assembly is removably and pivotally mounted between an opened vehicle trunk lid and a trunk floor. The column assembly includes top and bottom pivot pins which rotatably engage pivot pin receiving holes and about which the boom assembly rotates. The column assembly and boom assembly are collapsible so as to allow the trunk lid to close.

6 Claims, 2 Drawing Sheets

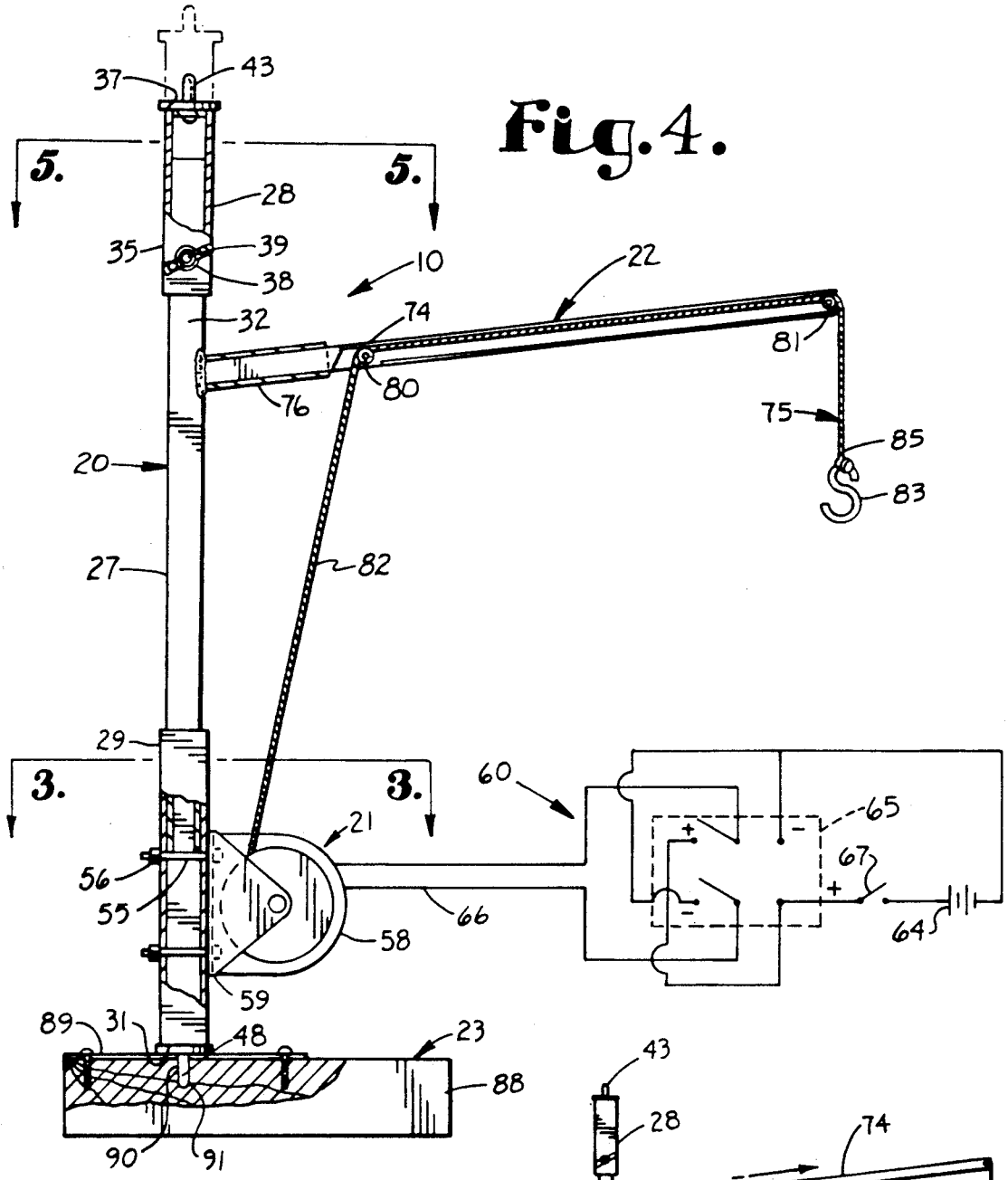
Fig. 4.
Fig. 5.
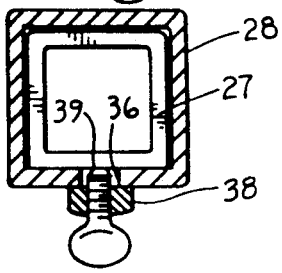
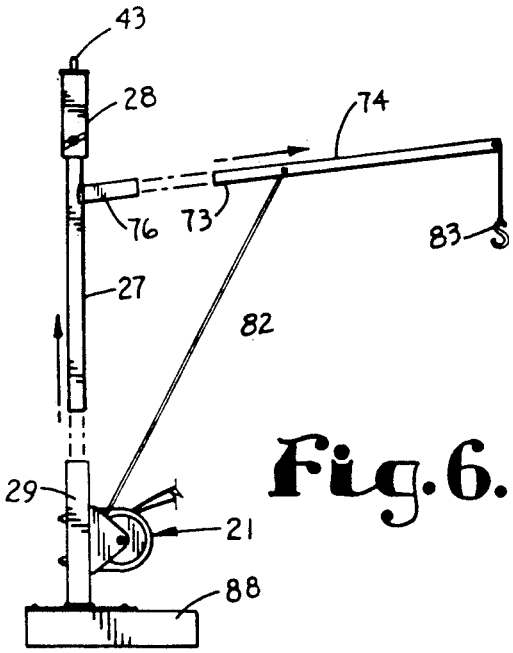
Fig. 6.

TRUNK-MOUNTED PORTABLE CRANE

BACKGROUND OF THE INVENTION

The present invention relates generally to hoisting and lifting devices, and particularly to a portable crane for hoisting and lifting objects into and out of a vehicle trunk.

Present hoisting and lifting devices, such as cranes, are utilized in a variety of applications. One such application is assisting disabled persons in transporting their personal mobility vehicles, electric scooters, wheelchairs, and the like. Many such persons are capable of driving automobiles but need the assistance of special equipment to retain personal mobility and independence. This equipment, however, is often bulky, cumbersome and heavy, requiring special lift devices to enable people, especially those who are disabled or infirm, to load or unload it in or from their vehicles.

The Mann U.S. Pat. No. 4,127,200 discloses a wheelchair lift device for mounting in a vehicle trunk. The steps necessary for setting up and installing the Mann device in the trunk, however, may prove difficult and time-consuming. Additionally, the Mann device is not easily transferrable among different vehicles and the folding feature may prove ineffectual when the vehicle trunk is full. Heretofore there has not generally been available a crane or lift device with the advantages and features of the present invention.

SUMMARY OF THE INVENTION

In practice of the present invention, a crane or lift device is provided for raising, lowering and swinging objects. The crane includes a column assembly with top and bottom pivot pins. The bottom pivot pin engages a base block situated on a vehicle trunk floor and the top pivot pin engages an opened trunk lid. A boom arm is removably secured to the column assembly and can swing about the rotational axis formed by the pivot pins. The boom arm has mounted at both ends pulleys having a cable reeved thereover. One end of the cable mounts a hook and the other end attaches to a motorized winch, which can be mounted on the column assembly. The boom arm can be removed from the column assembly and the column assembly can be disengaged from the trunk lid. This allows the crane to be collapsed so as to allow closure of the trunk or movement of the crane to another vehicle.

OBJECTS AND ADVANTAGES OF THE INVENTION

The principal objects and advantages of the present invention include: providing a crane; providing such a crane for lifting and swinging objects; providing such a crane which is adaptable for installation in or on a vehicle; providing such a crane which can load and unload objects in and from a vehicle trunk; providing such a crane which is portable; providing such a crane which is collapsible; providing such a crane which requires minimal modifications to the vehicle for installation; providing such a crane which is adapted for loading and unloading an electric scooter; providing such a crane which can be used with different vehicles; providing such a crane which can be installed in many vehicle trunks; providing such a crane which is economical in construction, efficient in operation, capable of long operating life, simple to assemble and disassemble and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a left side elevational view of the crane with portions broken away to show the relationship between the elements.

FIG. 5 is an enlarged, horizontal, cross-sectional view of the crane, taken generally along line 5—5 in FIG. 4.

FIG. 6 is a left side elevational view of the crane, particularly showing the disassembly thereof.

DETAILED DESCRIPTION OF THE INVENTION

I. Introduction and Environment

Figure 2:
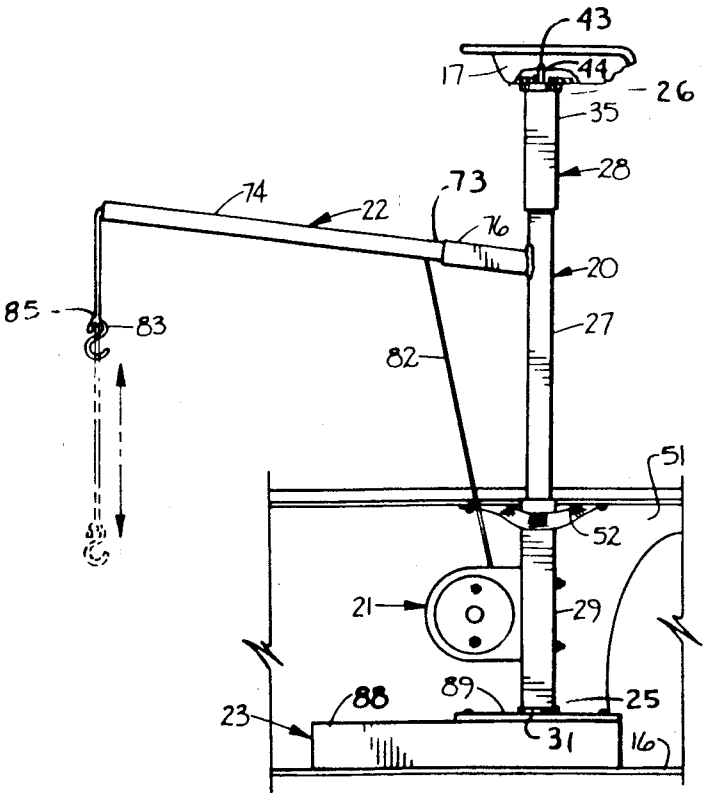
FIG. 2 is a right side elevational view of the crane and a trunk wall.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 10 generally designates a crane embodying the present invention. Without limitation on the generality of useful applications of the crane 10, an exemplary application is shown in a vehicle storage compartment such as a trunk 12 of an automobile 14 with the crane 10 removably installed between a trunk floor 16 and a trunk lid 17. The trunk 12 can be selectively opened and closed by the trunk lid 17.

The crane 10 generally comprises a column assembly 20, a winch assembly 21, a boom assembly 22 and base means 23.

II. Column Assembly 20

The column assembly 20 has a lower end 25 and an upper end 26 and column height adjustment means. The column assembly 20 is removably and pivotally mounted between the trunk floor and the opened trunk lid 17 and further includes a column member 27, an elongating subassembly 28 and a lower or column member sleeve 29. The column member 27 is generally linear.

The elongating subassembly 28 includes an upper sleeve or elongating member 35 which has a bolt receiving hole 36 passing through it and is hollowly constructed to slidably receive the upper portion of the column member 27. The elongating subassembly 28 further includes a nut 38 welded to the upper sleeve 35 in alignment with the bolt receiving hole 36. A wing bolt 39 is threadably received in the nut 38 and extends through the bolt receiving hole 36 for impinging upon the column member 27. By tightening the wing bolt 39 the upper sleeve 35 can be fixed in position on the member 27. This arrangement fixedly maintains the relative position between the elongating member 35 and the column member 27 at selected points along the column member 27. As the relative position is changed, the column assembly 20 can be telescopically lengthened and shortened.

The elongating member 35 includes a top end 37 which is mounted by a cap having a top pivot pin 43 which rotably engages and disengages a top pivot pin receiving hole 44 in the trunk lid 17 as the elongating subassembly 28 is lengthened and shortened respectively, as shown in FIG. 4. A lower portion 30 of the column member 27 is removably and slidably received by the hollowly constructed column member sleeve 29. A bottom end 31 of the column member sleeve 29 is mounted on the base means 23 by a bottom pivot pin 48. As shown in FIG. 2, additional stability can be obtained by loosely securing the column member 27 to a trunk wall 51 by a strap 52.

III. Winch Assembly 21

The winch assembly 21 includes reel means 57, motor means 58 for reversibly driving the reel means 57, a motor mount subassembly 59 and a control subassembly 60. The motor mount subassembly 59 has a generally cleavis-shaped configuration with first and second arms 61, 62 interconnected by a base 63. The winch assembly 21 is mounted on the column 20 between its upper end 26 and its lower end 25 on the sleeve 29 by mounting bolts 55 which extend through the motor mount subassembly base 63 and the sleeve 29. The mounting bolts 55 impinge upon the column member lower portion 30 when the column member 27 is placed in the sleeve 29. The mounting bolts 55 threadably receive nuts 56.

The control subassembly 60 includes a power supply 64, e.g. the electrical system of the automobile 14, which is coupled to the motor means 58 through a control switch 65. The control switch 65 can include suitable switch means for driving the motor 58 in forward and reverse corresponding to raising and lowering operations of the crane 10. For example, a double pole, double throw switch with an off position in the center can be provided for reversing the polarity of the direct electrical current supplied to the motor means 58 from the power supply 64. The control switch 65 can be mounted in an enclosure or housing suitable for being hand held, and can be coupled to the motor 58 by an electrical cable 66 of sufficient length to enable the operator to guide a load on the crane 10 from a convenient position behind the automobile trunk 12. A momentary contact switch 67, such as a trigger, can be placed in one of the lines from the power source 64 to the control switch 65.

IV. Boom Assembly 22

The boom assembly 22 includes a boom arm 74, engagement means 75 and a boom arm sleeve 76. The engagement means 75 are associated with the boom arm 74 and are adapted for engaging a load, e.g. an electric scooter 70. The winch assembly 21 cooperates with the engagement means 75 to hoist the electric scooter 70. The engagement means 75, as shown in FIG. 4, includes a first pulley 80 rotatably supported at the proximate section of the boom arm 74 and a second pulley 81 rotatably supported at the distal end of the boom arm 74. The boom arm 74 has a tensile member such as a cable 82 slidably connected thereto and which is extendable and retractable with respect to the boom arm 74. The pulleys 80 and 81 can be rotatably mounted in a passage extending longitudinally through the boom arm 74 and have a cable 82 reeved over them. A proximate end 84 of the cable 82 is secured to the reel means 57 and a distal end 85 is secured to a hook member 83 for engaging the electric scooter 70. A proximate section 73 of the boom arm 74 is removably and slidably received by a boom arm sleeve 76 which is securely attached to the column member 27.

V. Base Means 23

The base means 23 includes a base block 88 and a base plate 89 securely affixed thereto. The base block 88 is made of a rigid material capable of bearing weight without substantial deformation, such as wood, and can be placed on the trunk floor 16 in an unsecured manner. The base plate 89 has a bottom pivot pin receiving hole 90, corresponding to a hole 91 in the base block, in which the bottom pivot pin 48 rotatably engages the base means 23.

VI. Operation

Although the crane 10 is shown installed in an automobile trunk 12, there is a wide variety of other useful applications. For example, other vehicles with hatchback, station wagon and pickup truck configurations could employ the crane 10 for raising, lowering and swinging various objects.

Figure 1:
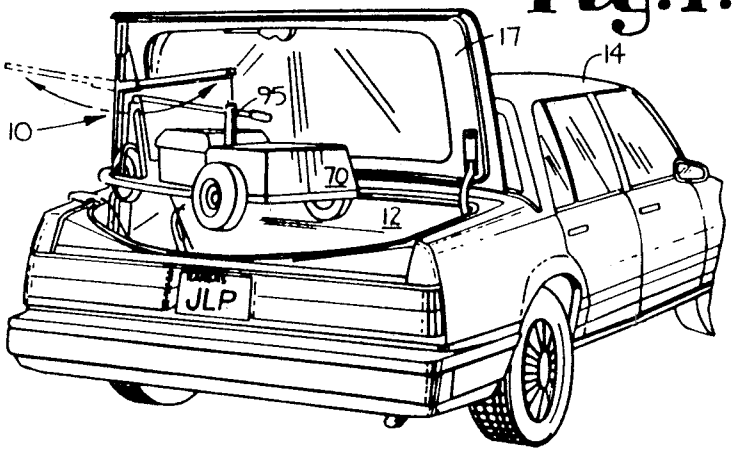
FIG. 1 is a rear perspective view of a crane or lift device shown installed in a vehicle trunk and loading or unloading an electric scooter, in accordance with a preferred embodiment of the present invention.
Figure 3:
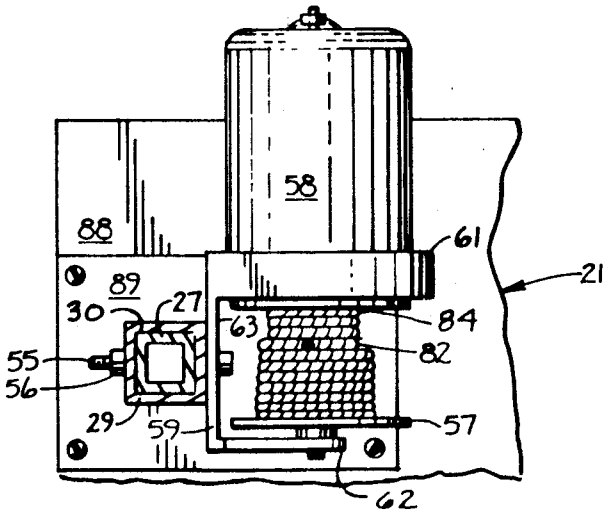
FIG. 3 is an enlarged, horizontal, cross-sectional view of the crane, taken generally along line 3—3 in FIG. 4.

FIG. 1 shows the crane 10 engaging the electric scooter 70 for loading into or unloading from the automobile trunk 12. The hook 83 may be engaged on a suitable member such as a seat post 95 of the scooter 70. The control means 65 then causes the motor means 58 to drive the reel means 57 so that the cable 82 is retracted, thus raising the hook 83, as shown in FIG. 2, and consequently raising the scooter 70. The scooter 70 is raised to a sufficient height for clearing the rear parts of the automobile 14 for entrance into the trunk 12 when the scooter 70 is fully raised; the boom arm 74 can then be swung inwardly and forwardly (which rotates the column assembly 20 about a generally vertical axis defined by the pivot pins 43 and 48) until the scooter 70 is positioned for lowering into the trunk 12. After the scooter 70 comes to rest on the trunk floor 16, as shown in FIG. 5, the boom arm 74 can be slidably withdrawn from the boom arm sleeve 76, the column assembly 20 can be shortened or the trunk lid 17 raised so as to disengage the top pivot pin 43 and the column member 27 can be slidably withdrawn from the column member sleeve 29. The column member 27 cooperates with the elongating subassembly 28 to shorten the column assembly 20. The wing bolt 39 can be loosened so as to allow movement of the elongating member 35 relative to the column member 27. Alternatively, the height of the column assembly 20 can be set so as to allow the top pivot pin 43 to clear the top pivot pin receiving hole 44 by raising the trunk lid 17. This collapsed arrangement allows the trunk lid 17 to be closed. The reverse operation may be carried out to unload the scooter 70.

It is to be understood that while certain forms of the present invention have been illustrated and described herein, it is not to be limited to the specific forms or arrangement of parts described and shown.

What is claimed and desired to be secured by Letters Patent is as follows:

1. In combination with a vehicle including a storage compartment with a hinged lid movable between a lowered, close position and an upper, open position, the improvement of a crane, which comprises:

(a) a column assembly including:
  (i) a column member with upper and lower ends;
  (ii) an upper sleeve with an open, lower end telescopically receiving said column member upper end and a sleeve upper end;
  (iii) said upper sleeve including an upper sleeve cap mounted on said upper sleeve upper end and an upper pivot pin extending upwardly from said upper sleeve cap;
  (iv) a lower sleeve including an open, upper end telescopically receiving said column member lower end and a lower sleeve lower end;
  (v) said lower sleeve including a lower sleeve cap mounted on said lower sleeve lower end and a lower pivot pin depending from said lower sleeve cap;
  (vi) column length adjustment means adjustably clamping said column member upper end to said upper sleeve;

(b) an upper pivot pin receiver in said compartment lid, said upper pivot pin receiver rotatably receiving said upper pivot pin;

(c) a base positioned within said compartment and including an upper surface and a lower pivot pin receiver open at said upper surface, said lower pivot pin receiver rotatably receiving said lower pivot pin;

(d) a winch assembly, which includes:
  (i) a winch mounting bracket mounted on said lower sleeve;
  (ii) a winch mounted on said winch mounting bracket;
  (iii) a reversible electric motor drivingly connected to said winch; and
  (iv) a switch coupled to said electric motor and adapted for energizing same for forward and reverse drive; and (e) an arm assembly including:
  (i) a boom arm with a proximate end mounted on said column member and a distal end; and
  (ii) a tensile member with a proximate end mounted on said winch and a distal end, said tensile member being extendable and retractable by said winch and being slidably connected to said boom arm and extending from the distal end thereof.

2. In combination with a vehicle including a storage compartment with a hinged lid movable between a lowered, close position and an upper, open position, the improvement of a crane, which comprises:

(a) a column assembly removably and pivotally mounted between the floor of the compartment and the open lid including:
  (i) a column member with upper and lower sections having upper and lower ends respectively;
  (ii) column assembly height adjustment means including an upper sleeve with an upper end mounted by a cap with a pivot pin projecting upwardly from said cap and having a bolt receiving hole passing through said upper sleeve, a length adjustment bolt member and tightening means; said upper sleeve telescopically receiving said column member upper end; said upper pivot pin rotatably engages and disengages an upper pivot pin receiver in the open lid as said column assembly height adjustment means lengthens and shortens, respectively, said column assembly; said length adjustment bolt passes through said bolt receiving hole, and out of said bolt receiving hole where said length adjustment cooperates with said tightening means to fixedly maintain the position of said elongating member in relation to said column member and thus in relation to said column member upper section; said tightening means threadably receive said length adjustment bolt; and
  (iii) a lower sleeve with a bottom end; said lower sleeve telescopically receiving said column member lower end; said lower sleeve bottom end is mounted by a bottom pivot pin;

(b) a winch assembly including:
  (i) reel means;
  (ii) motor means for driving said reel means; said motor means includes a reversible electric motor drivingly connected to said winch assembly; said motor comprising a direct current electrical motor;
  (iii) a motor mount subassembly for securely attaching said winch assembly to said lower sleeve; said motor mount subassembly impinges upon said column member so that said lower sleeve only receives said column member lower section; and
  (iv) a control subassembly; said control subassembly includes a power supply for supplying power to said motor means and control means for instructing said motor means to drive said reel means; said power supply includes an automobile electrical power supply; said control means includes a double pole, double throw switch coupled to said electric motor for reversing the polarity of electrical current supplied thereto and a momentary contact switch serially coupled to said double pole, double throw switch; said switches being mounted in a hand-held housing with electrical leads extending to said electric motor;

(c) a boom assembly including:
  (i) a boom arm with proximate and distal sections having proximate and distal ends, respectively, removably secured to said column member; said boom arm having a passage extending longitudinally therethrough;
  (ii) engagement means associated with said boom arm; said engagement means includes a first pulley rotatably mounted in said boom arm passage at said boom arm proximate section and a second pulley rotatably mounted in said boom arm passage at said boom arm distal end; said pulleys support a tensile member having proximate and distal ends; said tensile member proximate end is secured to said reel means which is driven by said motor means; said tensile member is reeved through said pulleys; said tensile member distal end is mounted by a hook member; and (iii) a boom arm sleeve projecting outwardly from said column member which is hollowly constructed to removably and slidably receive said boom arm proximate end; said boom arm receiving sleeve includes a proximate end fixedly attached to said column member upper section and an open distal end; and (d) base means including:

(i) a base block situated on the floor of the compartment with an upper surface having a lower pivot pin receiving hole open at said upper surface; said base means further includes a base plate securely mounted to said base block upper surface and having a receiver corresponding to said lower pivot pin receiving hole; said lower pivot pin receiving hole is rotatably engaged by said lower pivot pin.

3. A crane for mounting in the trunk of a vehicle having a trunk lid and a trunk floor, comprising:

(a) base means for supporting said crane as said base means is placed unsecured on the trunk floor;

(b) a column assembly including:

(1) a column having:

(A) an upper end; and (B) a lower end releasably and rotatably engaged with said base means; and (2) trunk lid mounting means for mounting said column assembly on said trunk lid such that said upper end thereof is releasably and rotatably engaged with said trunk lid;

(c) a boom assembly including:

(1) a boom arm having:

(A) a proximal end and a distal end;

(B) a passage extending longitudinally through said boom arm;

(C) a first pulley rotatably mounted in said passage near said proximal end of said boom arm; and (D) a second pulley rotatably mounted in said passage at said distal end of said boom arm; and (2) a boom arm sleeve having a proximal end rigidly secured to said column and a distal end adapted to releasably receive said proximal end of said boom arm;

(d) a winch assembly mounted on said column; said winch assembly including:

(1) reel means;

(2) a reversible electric motor drivingly connected to said reel means; and (3) a control subassembly such that electrical power can be selectively and reversibly supplied to said motor by a user conveniently positioned behind the vehicle; and (e) a tensile member having a first end connected to said reel and a second end reeved over said first pulley and said second pulley and having a hook connected to the distal end thereof.

4. The invention of claim 3 wherein said control subassembly includes:

(a) a double pole, double throw switch coupled to said electric motor for reversing the polarity of electrical current supplied thereto; and (b) said motor comprising a direct current electrical motor.

5. The invention of claim 4, which includes:

(a) a momentary contact switch serially coupled to said double pole, double throw switch;

(b) said switches being mounted in a hand-held housing; and (c) electrical leads extending from said switch housing to said electric motor.

6. A crane for mounting in the trunk of a vehicle having a trunk lid and a trunk floor, comprising:

(a) a receiver in the trunk lid;

(b) base means for supporting said crane as said base means is placed unsecured on the trunk floor;

(c) a column assembly including:

(1) a column having:

(A) an upper end; and (B) a lower end releasably and rotatably engaged with said base means; and (2) adjustment means for slidably adjusting the height of said column assembly such that said upper end is releasably and rotatably engaged with said receiving hole as said lower end is engaged with said base means;

(d) a boom assembly including:

(1) a boom arm having:

(A) a proximal end and a distal end;

(B) a passage extending longitudinally through said boom arm;

(C) a first pulley rotatably mounted in said passage near said proximal end of said boom arm; and (D) a second pulley rotatably mounted in said passage at said distal end of said boom arm; and (2) a boom arm sleeve having a proximal end rigidly secured to said column and a distal end adapted to releasably receive said proximal end of said boom arm;

(e) a winch assembly mounted on said column; said winch assembly including:

(1) reel means;

(2) a reversible electric motor drivingly connected to said reel means; and (3) a control subassembly such that electrical power can be selectively and reversibly supplied to said motor by a user conveniently positioned behind the vehicle; and (f) a tensile member having a first end connected to said reel and a second end reeved over said first pulley and said second pulley and having a hook connected to the distal end thereof.

* * * * *